United States Patent [19]

Shimizu et al.

[11] Patent Number: 4,978,596

[45] Date of Patent: Dec. 18, 1990

[54] ELECTROPHOTOGRAPHIC TONER COMPRISING LACTONE-MODIFIED EPOXY RESIN

[75] Inventors: Ryuichi Shimizu, Hitachiota; Tsuneaki Kawanishi, Hitachi; Shigeo Suzuki, Hitachi; Shigeo Hosaka, Hitachi; Yasuki Mori, Hitachi; Toshikazu Narahara, Ibaraki, all of Japan

[73] Assignee: Hitachi, Ltd., Tokyo, Japan

[21] Appl. No.: 840,198

[22] Filed: Mar. 17, 1986

[30] Foreign Application Priority Data

Mar. 25, 1985 [JP] Japan ..... 60-58478
Mar. 29, 1985 [JP] Japan ..... 60-63649

[51] Int. Cl.[5] ..... G03G 9/00
[52] U.S. Cl. ..... 430/109; 430/904
[58] Field of Search ..... 430/110, 109, 904

[56] References Cited

U.S. PATENT DOCUMENTS

| | | | |
|---|---|---|---|
| 2,297,691 | 10/1942 | Carlson | 430/31 X |
| 3,185,777 | 5/1965 | Rheinfraub | 430/107 X |
| 3,595,794 | 7/1971 | Hagenbach et al. | 430/108 |
| 4,105,572 | 8/1978 | Gorondy | 430/106 |
| 4,492,789 | 1/1985 | Nakashima et al. | 525/533 |
| 4,522,984 | 6/1985 | Watanabe et al. | 525/415 |

FOREIGN PATENT DOCUMENTS

| | | |
|---|---|---|
| 0127375 | 12/1984 | European Pat. Off. . |
| 2506086 | 9/1975 | Fed. Rep. of Germany . |
| 2931087 | 2/1980 | Fed. Rep. of Germany . |
| 2101605 | 1/1983 | United Kingdom . |

*Primary Examiner*—J. David Welsh
*Attorney, Agent, or Firm*—Antonelli, Terry, Stout & Kraus

[57] ABSTRACT

The present invention provides an electrophotographic toner, particularly with a good transferability and a good flowability, which comprises a binder resin and a coloring agent, the binder resin containing a lactone-modified epoxy resin, obtained by subjecting all or a portion of secondary hydroxyl groups of epoxy compounds having hydroxyl groups in the molecules to ring opening polymerization of lactone.

The present invention further provides an electrophotographic toner with a good transferability, a good flowability and a good offset resistance and also with a fixability of transferred images, which comprises a binder resin and a coloring aent, the binder resin containing:

(1) a lactone-modified epoxy resin, obtained by subjecting all or a portion of secondary hydroxyl groups of epoxy compounds having hydroxy groups in the molecules to ring opening polymerization of lactone,
(2) styrene-butadiene rubber, and
(3) polyester resin.

6 Claims, No Drawings

ELECTROPHOTOGRAPHIC TONER COMPRISING LACTONE-MODIFIED EPOXY RESIN

BACKGROUND OF THE INVENTION

This invention relates to an electrophotographic toner, and particularly to a toner having a distinguished transferability from a photosensitive material to a transfer sheet and a distinguished filming resistance to the photosensitive material.

Electrophotography is carried cut mainly by forming an electrostatic latent image on a photosensitive material such as selenium, zinc oxide or organic photoconductors, contacting the latent image with a mixture of carriers such as fine glass beads, iron powder, ferrite powder, etc., and electro-insulating, colored fine toners, the toners having been triboelectrically charged, thereby conducting an electrostatic development, then laying a transfer sheet on the developed image and transferring the developed image onto the transfer sheet under an electric field.

Heat-fixing type toners for use in the electrophotography contain a binder resin. Various thermoplastic and thermosetting resins are used as binder resins. The resins melt or soften by heating, and the image is fixed to the transfer sheet such as paper, etc. From the viewpoints of toner characteristics, such as electrostatic characteristics, flowability, etc. styrene resin, styrene-acrylonitrile copolymer resin, epoxy resin, polyester resin, etc. have been mainly used as the binder resin.

On the other hand, with recent higher printing speed in electrophotography, a better image quality has been required, and thus studies of an improvement in the image quality and the friability of an image have been initiated.

To improve the fixability of an image, the heating temperature for the fixation must be elevated so that the binder resin can be thoroughly melted. However, a small scale type or an energy-saving type has been recently required for copying machines or laser beam printers, and toners capable of melting and softening at a low temperature have been required without elevating the heating temperature.

A lower melting or softening temperature of toners means lowering of other characteristics of toners, such as toner flowability and toner preservation stability (toner coagulation resistance), and thus a better image quality is hard to obtain. Even if a better image quality is obtained, no better fixability of an image after the fixation can be obtained.

Furthermore, when the image-fixed sheet after the fixation is placed in a soft polyvinyl chloride bag, the toner image fixed on the sheet will be partially transferred to and deposited on the soft polyvinyl chloride surface, if styrene resin or styrene-acrylonitrile copolymer resin is used as a binder resin. Such a transfer seems to be caused by dissolution of the styrenic binder resin by a plasticizer in the soft polyvinyl chloride, for example, dibutyl phthalate or dioctyl phthalate.

Copied documents are often placed in transparent soft polyvinyl chloride bags and the transfer of toner images during the preservation as mentioned above has been a serious problem.

The transferability of the toner image to soft polyvinyl chloride hereinafter referred to as "PVC resistance") can be prevented by using epoxy resin as a binder resin. However, toner deposition onto a drum surface of selenium as a photosensitive material (toner filming) takes place earlier when the epoxy resin is used as a binder resin, and thus lowering of image contrast and fogging of white background and poor transfer of toner image are liable to take place. Thus, the life of photosensitive material itself will be apparently shorter and the maintenance of the photosensitive material will be more frequently required.

The heat fixation of electrophotography includes fixation by oven heating, flash fixation by a halogen lamp (U.S. Pat. No. 4,352,877), heat roll fixation with heat and pressure, etc., among which the heat roll fixation has a better fixability and can be made at a higher speed. Particularly with an increase in printing speed of copying machines, laser beam printers, etc. based on the electrophotographic process and also with a keener demand for high speed fixation, the heat roll fixation has been more and more employed. Heat roll fixation is carried out by pressing and heating with a heat roll made from a silicone rubber or fluoro-resin of good surface lubrication, further coated with a surface lubricant such as silicone oil, etc. or with a heat roll made from silicone rubber impregnated with silicone oil.

In the heat roll fixation, it is required that the so called offset phenomena, i.e. image fouling by deposition of a portion of toners onto the heat roll surface and further deposition onto paper because the toners in a heated and molten state are pressed onto the heat roll surface (hereinafter referred to as "offset resistance") may not take place. Needless to say, a fixation stability of image after the fixation is also required.

Styrene-grafted epoxy resin has been proposed as an intermediate resin between the styrenic resin and the epoxy resin [Japanese patent application Kokai (Laid-open) Nos. 58-203452 and 59-24865]. However, the resin, even though used as a binder resin, has an offset resistance no more than that of the single epoxy resin and rather has a poor PVC resistance because the styrene resin component is contained.

SUMMARY OF THE INVENTION

An object of the present invention is to provide an electrophotographic toner having a distinguished transferability (transfer efficiency) and a distinguished flowability.

Another object of the present invention is to provide an electrophotographic toner less depositable onto the surface of a photosensitive material, i.e. a toner having a distinguished filming resistance.

Other object of the present invention is to provide an electrophotographic toner having a distinguished fixability and a distinguished offset resistance.

Still other object of the present invention is to provide an electrophotographic toner having a distinguished PVC resistance of an image after the fixation.

Further objects will be apparent from the disclosure of the specification.

According to a first aspect of the present invention, an electrophotographic toner comprising a binder resin and a coloring agent is characterized in that the binder resin contains a lactone-modified epoxy resin having a lactone content of 3 to 90% by weight, obtained by subjecting all or a portion of secondary hydroxyl groups of epoxy compounds having hydroxyl groups in the molecules to ring-opening polymerization of lactones.

According to a second aspect of the present invention, an electrophotographic toner comprising a binder resin and a coloring agent, characterized in that the binder resin contains (1) a lactone-modified epoxy resin having a lactone content of 3 to 90% by weight, obtained by subjecting all or a portion of secondary hydroxyl groups of epoxy compounds having hydroxyl groups in the molecules to ring-opening polymerization of lactones, (2) styrene-butadiene rubber, and (3) polyester resin.

In the present binder resin, the lactone-modified epoxy resin is effective for the improvement of transferability and flowability of toners and also for the improvement of PVC resistance of an image after the fixation and for the filming resistance with less depositability onto the surface of photosensitive material. The styrene-butadiene rubber is effective for the improvement of offset resistance of toners, and the polyester resin is effective for the improvement of fixation of toners.

The epoxy compounds for use in the present invention include glycidyl ether type epoxy resins obtained from bisphenol A and epichlorohydrin, e.g. Epikote 828, Epikote 1001, etc., (trademarks of products made by Shell Chemical Co.); epoxy resin types obtained by addition of bisphenol A with an alkylene oxide, followed by reaction with epichlorohydrin, e.g. EP-4000, etc., (trademarks of products made by Asahi Denka K.K., Japan), epoxy resin types obtained with methylepichlorohydrin in place of epichlorohydrin in the preparation of the foregoing types, e.g. Epiclon 800, etc., (trademarks of products made by Dainihon Ink and Chemicals Co., Japan), epoxy compounds based on phenol novolak or cresol novolak, diglycidyl terephthalate, 3,4-epoxycyclohexyl carboxylate known as alicyclic epoxy resin Celloxide 2021, etc., (trademarks of products made by Daicel Kagaku Kogyo K.K., Japan), epoxy compounds based on phthalic acid or hexahydrophthalic acid Shodyne 508, etc. (trademarks of products made by Showa Denko K.K., Japan), etc.

The lactones for use in the present invention include 4-membered cyclic propiolactone and 7-membered cyclic lactone, and preferable is ϵ-caprolactone.

The lactone content of lactone-modified epoxy resin by subjecting an epoxy compound to ring-opening polymerization of lactone ring is 3 to 90% by weight, preferably 3 to 80% by weight on the basis of total resin.

Preferable softening point (a ring and ball method) of the epoxy resin after the lactone modification as a toner binder resin is 100° to 150° C., and preferable glass transition point thereof is 50° C. or more.

A process for preparing a lactone-modified epoxy resin will be briefly described below.

Ring-opening polymerization of ϵ-caprolactone with the secondary hydroxyl groups of epoxy resin is carried out at 70° to 170° C., preferably 80° to 150° C. Below 70° C., the reaction rate is low, whereas above 170° C. there is a possibility for occurrence of gelation of epoxy resin. In the reaction, it is preferable to use a catalyst. The catalyst includes titanium compounds such as tetrabutyl titanate, tetrapropyl titanate, tetraethyl titanate, etc.; organic tin compounds such as tin octylate, dibutyl tin oxide, dibutyl tin dilaurate, etc.; tin halides such as stanuous chloride, stanuous bromide, stanuous iodide, etc. The amount of the catalyst to be used is 1,000 to 0.01 ppm, preferably 500 to 0.2 ppm on the weight basis of total reaction mixture.

The reaction can be carried out in the absence of a solvent. In case of the reaction in the presence of a solvent, a solvent having no active hydrogen, such as toluene, xylene, methylethylketone, methylisobutylketone, etc. is used.

Fixation by heating and pressing with a heat roll using the lactone-modified epoxy resin only as a binder resin has a problem in the offset resistance. To improve the offset resistance, it is preferable to add styrene-butadiene rubber thereto. Partially cross-linked styrene-butadiene rubber having a gel content of 10 to 50% by weight is preferable as styrene-butadiene rubber. By using the partially cross-linked styrene-tutadiene rubber, the offset resistance can be improved without any decrease in the preservation stability (coagulation resistance) of toners.

The offset resistance of the toners can be improved by adding the styrene-butadiene rubber to the lactone-modified epoxy resin, but the fixability is inevitably lowered with increasing offset resistance. Particularly the higher the speed of heat roll fixation, the more remarkable the decrease in the fixability by the addition of the rubber.

As a result of further studies on resin additives capable of endowing the fixability to the said mixture, the present inventors have found that further addition of polyester resin having a low softening point thereto is most effective.

Polyester resin is a polycondensed resin obtained by dehydration reaction of a carboxylic acid with a hydroxy compound. Physical properties of a melt, such as softening point, glass transition point, etc. can be selected as desired by selecting monomer species and reaction conditions, and thus the polyester resin has been recently used as a toner resin. For example, well known polyester resins such as linear polyester resin synthesized from a diol and a dicarboxylic acid, non-linear polyester resin synthesized from an at least trihydric polyol and a dicarboxylic acid including polycarboxylic acid, etc. can be used. Particularly when etherified bisphenols are used as a diol component, a suitable resin can be obtained, where the softening point of the resin can be set to 100° to 150° C., and the glass transition point to 50° C. or more.

Furthermore, cross-linked polyester resin containing at least trihydric polyol or polycarboxylic acid has a remarkable effect on the improvement of toner fixability. Thus, a good fixability can be obtained at a high speed heat roll fixation by adding these polyester resins to the said mixture.

The binder resin for use in the present invention can be prepared in the foregoing manner. The present toners can contain an anti-offset agent usually used to further improve the offset resistance of toners. The anti-offset agent includes polyolefins, metal salts of fatty acids, fatty acid esters, partially saponified fatty acid esters, higher fatty acids, higher alcohols, paraffin wax, polyhydric alcohol esters, etc. Particularly, low molecular weight polypropylene and polyethylene waxes having molecular weights of not more than 50,000 are effective.

In preparation of toners from a mixture of the said resins, temperature, pressure, fixation speed, etc. at heat roll fixation must be taken into account. Toners having a good fixability and a distinguished offset resistance can be usually obtained by selecting a resin composition so that the melt viscosity of toners at 160° C. may be 100 to 10,000 poises.

The amount of styrene-butadiene rubber to be added must be in a range of 5 to 30% by weight on the basis of total binder resin. Below 5% by weight the effect on the improvement of the offset resistance is small, whereas above 30% by weight the fixability, preservation stability and PVC resistance of the toners will be decreased.

In the present invention, the amount of polyester resin to be added must be in a range of 5 to 50% by weight on the basis of the total binder resin.

When an ordinary anti-offset agent is used together, the anti-offset agent capable of melting at a lower temperature than the softening point of binder resin must be used. The amount of the anti-offset agent to be used is usually 0.5 to 20% by weight, preferably 1 to 10% by weight, on the basis of total binder resin.

The present toners can contain a coloring agent in the binder resin, and furthermore can contain characteristics-improving agents such as a charge-controlling agent, etc., when required. When magnetic toners are to be obtained, a magnetic material must be added to the toners.

The coloring agent includes carbon black, aniline blue, Carco oil blue, chrome yellow, ultramarine blue, DuPont oil red, quinoline yellow, methylene blue chloride, phthalocyanin blue, malachite green oxalate, lamp black, rose bengal, etc. The amount of the coloring agent to be added is usually 1 to 20% by weight on the basis of total toner.

The magnetic material includes ferrite, magnetite, and alloys or compounds containing ferromagnetic elements such as iron, cobalt, nickel, etc., and various other ferromagnetic alloys. Examples of the magnetic material are magnetite ($Fe_3O_4$), Co-containing magnetite, spinel-type ferrite, magnetoplumbite-type ferrite, etc. These magnetic materials are uniformly distributed in the form of fine powders having an average particle size of 0.3 to 1 μm into the binder resin. The smaller the amount of the magnetic material powder, the better the fixability. In case of magnetic toners, an appropriate amount of the magnetic material to be added is 40 to 60% by weight on the basis of total toner.

Evaluation of the fixability and offset resistance of the present toners was carried out by both adhesive tape peeling test and visual inspection of toner images fixed on transfer sheets by pressing and heating by passing toner image-bearing transfer sheets through a heated metallic heat roll coated with a fluoro resin and a heated silicone rubber roll.

Evaluation of the PVC resistance was carried out by laying a soft polyvinyl chloride sheet having a dioctyl phthalate content of 50% by weight on a toner print and leaving the sheet on the print under the pressure of 100 g/cm$^2$ at 50° C. and 27% RH for 1,200 hours to inspect the transfer of toner from the print to the soft polyvinyl chloride sheet.

THE PREFERRED EMBODIMENTS OF THE INVENTION

One example of a process for preparing lactone-modified epoxy resin for use in the present invention will be given below.

PREPARATORY EXAMPLE 1,800 parts by weight of epoxy resin ESA-017 (trademark of a product made by Sumitomo Kagaku Kogyo K.K., Japan), 200 parts by weight of ε-caprolactone, 0.005 parts by weight of stanuous chloride and 0.5 parts by weight of monomethoxyhydroquinone were charged into a four-necked flask provided with a nitrogen inlet pipe, a thermometer, a cooling pipe, and a stirrer, and subjected to reaction at 140° C. for 24 hours and then at 120° C. for 240 hours while passing a nitrogen gas therethrough. Then, the reaction mixture was left standing for cooling down to room temperature, whereby lactone-modified epoxy resin having a lactone content of 10% by weight and a softening point of 120° C. was obtained.

EXAMPLE 1

830 parts by weight of lactone-modified epoxy resin having a softening point of 120° C. (JIS-K 2531: B & R method "Testing Procedure for Petroleum-Asphalt Softening Point") and a glass transition point of 70° C. [DSC (Differential Scanning Calorimetry) method], Placcel G 701 [trademark of lactone-modified epoxy resin (epoxy resin: Araldite 6097, trademark of Ciba-Geigy) having a lactone content of 10% by weight, made by Daicel Kagaku Kogyo K.K., Japan], 100 parts by weight of Carbon Black #40 (trademark of carbon black made by Mitsubishi Kasei Kogyo K.K., Japan), 50 parts by weight of Oil Black BY (trademark of a charge control agent made by Orient Kagaku Kogyo K.K., Japan), and 20 parts by weight of Viscol 660P (trademark of low molecular weight polypropylene made by Sanyo Kasei Kogyo K.K., Japan) were mixed together, kneaded in a kneader, cooled, pulverized and sieved, whereby black toners having particle sizes of 5 to 25 μm for a dry developing agent were obtained. 5 parts by weight of the thus obtained toners and 95 parts by weight of reduced iron powders having particle sizes of 70 to 110 μm were mixed together to prepare a developing agent.

Images were formed, using the developing agent through heat roll fixation by a laser beam printer H-8196-30 (trademark of printer made by Hitachi Koki K.K., Japan: printing speed: 15,000 lines/min.).

A transparent soft polyvinyl chloride sheet containing 50% by weight of dioctyl phthalate was tightly laid on the images to inspect the transfer of toners to the polyvinyl chloride sheet. It was found that no toners were transferred to the polyvinyl chloride sheet at all.

An adhesive tape 810 (trademark of a product made by Sumitomo-3M K.K., Japan) was pasted on the same images as obtained above, and then the tape was peeled off to inspect the fixability of toners. It was found that the image density retention ratio was as high as 98% after the peeling of tape on the basis of the initial image density (before the tape peeling test). The image density was determined by a reflection densitometer made by Dainihon Screen K.K., Japan.

Furthermore, transfer efficiency (transferability) of toners to be transferred onto a transfer sheet from a drum of selenium as a photosensitive material was investigated and found to be as high as 92%.

When 20,000 sheets of a test pattern were copied by the ordinary electrophotographic process using the said developing agent, no fouling of the photosensitive material or no toner filming was observed at all, or no deposition of toners onto the carrier surfaces of the developing agent was observed at all.

EXAMPLE 2

430 parts by weight of Placcel G701, 400 parts by weight of Placcel G401 [trademark of 10 wt. % lactone-modified epoxy resin. (epoxy resin: Araldite 6084, trademark of Ciba-Geigy) made by Daicel Kagaku Kogyo K.K., Japan], 100 parts by weight of Carbon Black #44 and 50 parts by weight of Oil Black BY were treated in the same manner as in Example 1, and images were formed, using the thus obtained toners and developing agent through flash fixation by a laser beam printer FACOM-6700D (trademark of Fujitsu K.K., Japan: printing speed 13,000 lines/min.). Results of evaluation obtained in the same manner as in example 1 revealed that no transfer of toners onto the polyvinyl chloride sheet was observed at all at 50° C. after 1,200 hours, and the image density retention ratio was as high as 97% after the adhesive tape peeling. The transfer efficiency was found to be 93% without any fouling on the photosensitive material or without any toner filming, or without any deposition of toners onto the carrier surface.

EXAMPLE 3

830 parts by weight of lactone-modified epoxy resin having a softening point of 140° C. and a glass transition point of 73° C., Placcel G90 [trademark of 10 wt. % lactone-modified epoxy resin (epoxy resin: YB-019, trademark of Toko Kasei K.K., Japan), made by Daicel Kagaku Kogyo K.K., Japan], 100 parts by weight of Carbon Black #44, 50 parts by weight of Oil Black BY and 20 parts by weight of Viscol 550P (trademark of low molecular weight polypropylene made by Sanyo Kasei Kogyo K.K., Japan) were treated in the same manner as in Example 1, and images were formed, using the thus obtained toners and developing agent through heat roll fixation by a laser beam printer H-8192 (trademark of Hitachi Koki K.K., Japan: printing speed: 3,000 lines/min.). Results of evaluation in the same manner as in Example 1 revealed that no transfer of toners onto the polyvinyl chloride sheet was observed at all at 50° C. after 1,200 hours, and the image density retention ratio was as high as 94% after the adhesive tape peeling. The transfer efficiency was 89% without any fouling on the photosensitive material, or without any toner filming or without any deposition of toners onto the carrier surfaces.

EXAMPLES 4–11

Lactone-modified epoxy resins having varied lactone contents were prepared, using ESA-017 as epoxy resin, in the same manner as in Preparatory Example, and toners and developing agents were prepared in the same mixing ratios as in Examples. The thus obtained toners and developing agents were evaluated in the same manner as in Example 1, and the results are shown in Table 1.

COMPARATIVE EXAMPLE 1

Toners and developing agent were prepared, using ESA-017 as epoxy resin in place of Plakcel G701 of Example 1, in the same manner as in Example 1. The thus obtained toners and developing agent were evaluated in the same manner as in Example 1, and the results are shown in Table 1.

As is obvious from the results of Table 1, the filming resistance using ϵ-caprolactone-modified epoxy resins as a binder resin has a life at least about 10 times as long as that using the ordinary epoxy resin, and also the transfer efficiency of toners and PVC resistance using the ϵ-caprolactone-modified epoxy resins as a binder resin are higher. Example 11 with the ϵ-caprolactone content of 95% had a problem of preservation stability. Thus, it is obvious from the results that the lactone content of the lactone-modified epoxy resins of 3 to 90% by weight is important.

TABLE 1

| | Comp. Example | Example | | | | | | | |
|---|---|---|---|---|---|---|---|---|---|
| | 1 | 4 | 5 | 6 | 7 | 8 | 9 | 10 | 11 |
| ϵ-caprolactone content (% by weight) | 0 | 2 | 3 | 20 | 50 | 80 | 90 | 93 | 95 |
| PVC resistance *1 50° C. 1200 | O | O | O | O | O | O | O | O | Δ (Adhesion by melting) |
| Fixability *2 ($D/D_0 \times 100\%$) | 78 | 82 | 90 | 96 | 95 | 97 | 98 | 98 | 96 |
| Filming resistance (Printing of 20,000 sheets of test pattern) | Filming occurred before printing of 2,000 sheets | Filming occurred before printing of 10,000 sheets | good | good | good | good | good | good | Toner deposition occurred after printing of 20,000 sheets |
| Tone transfer efficiency *3 ($(A_0 - A)/A_0 \times 100\%$) | 69 | 71 | 88 | 91 | 89 | 90 | 88 | 80 | 75 |
| Flowability *4 (seconds) | 62 | 58 | 55 | 52 | 53 | 52 | 54 | 57 | 64 |
| Preservation stability *5 50° C., 24 hr. | O | O | O | O | O | O | O or Δ | Δ | x |

*1 O: No transfer onto PVC sheets at all, Δ: Partial transfer onto PVC sheets; x: Substantial transfer onto PVC sheets
*2 $D_0$: Initial image density, D: Image density after tape peeling
*3 $A_0$: Weight of toners on the photosensitive material before toner transfer
A: Weight of toners remaining on the photosensitive material after toner transfer
*4 Developing agent consisting of 45 g of reduced iron powders having particle sizes of 70 to 110 μm and 5 g of toners was used. Time required for dropping of all 50 g of the developing agent from the JIS-2502 funnel under constant vibration.
*5 O: No change, Δ: Partial coagulation, x: Coagulated and impossible to use as toners.

EXAMPLE 12

Toners having particle sizes of 5 to 30 μm were prepared from 85 parts by weight of a binder resin, which consisted of 55 parts by weight of lactone-modified epoxy resin Placcel G701, 10 parts by weight of styrene-butadiene rubber having a glass transition point of 54° C. and a gel content of 30% by weight, Nippol 2007X (trademark of a product made by Nihon Geon K.K., Japan), 35 parts by weight of non-linear bisphenol-type polyester resin having a softening point of 116° C. and a glass transition point of 64° C., KTR 2150 (trademark of a product made by Kao Soap K.K., Japan) and 2 parts by weight of polypropylene having a molecular weight of 8,600, Viscol 66P (trademark of a product made by Sanyo Kasei Kogyo K.K., Japan), 5 parts by weight of oleic acid-modified nigrosine dye, Bontron N03 (trademark of a product made by Orient Kagaku Kogyo K.K., Japan), and 10 parts by weight of Carbon Black #44 (trademark of a product made by Mitsubishi Kasei Kogyo K.K., Japan).

A developing agent was prepared from 5 parts by weight of the thus obtained toners and 100 parts by weight of substantially spherical ferrite carriers having a volume resistivity of $10^9$ Ω·cm, an apparent density of 2.19 g/cm$^3$ and particle sizes of 74 to 149 μm KBN-100 (trademark of a product made by Hitachi Kinzoku K.K., Japan). Triboelectric charge of the toners to the carriers was determined according to a blow-off method (TB-200, trademark of Toshiba Chemical K.K., Japan) and found to be +15 μC/g.

A selenium drum rotating at a peripheral speed of 90 cm/sec. was uniformly charged at +700 V by a corona charger, and information was written thereon by He—Cd laser and subjected to reversal development using the said developing agent under a bias voltage of +400 V according to a magnetic brush method. Then, the toner images were transferred onto a continued paper sheet and fixed by a fixing apparatus of heat press roll type with a preheater at a roll temperature of 180° C., an interroll pressure of 4 kg f/au$^2$, a nip width (contact width of upper and lower rolls) of 8.5 cm and a fixing speed of 90 cm/sec. It was found that good images were obtained at a high image density without any fogging and any offsetting, showing a good fixability and a good PVC resistance.

Then, continuous printing test of 1,000,000 sheets was conducted while supplying the toners, and it was found that good images could be continuously obtained from the start to the end, and no filming of toners occurred at all on the selenium drum after the continuous printing.

EXAMPLE 13

Toners were prepared from 85 parts by weight of a resin binder, which consisted of 55 parts by weight of lactone-modified epoxy resin, Placcel G901, 10 parts by weight of styrene-butadiene rubber, 35 parts by weight of non-linear, bisphenol-type, polyester resin having a softening point of 148° C. and a glass transition point of 72.0° C., KTR 2100 (trademark of a product made by Kao Soap K.K., Japan), and 2 parts by weight of polypropylene having a molecular weight of 14,600, Viscol 550P (trademark of a product made by Sanyo Kasei Kogyo K.K., Japan), 5 parts by weight of stearic acid-modified nigrosine dye, Bontron NO2 (trademark of a product made by Orient Kagaku Kogyo K.K., Japan), and 10 parts by weight of Carbon Black #44 (trademark of a product made by Mitsubishi Kasei Kogyo K.K., Japan).

A developing agent was prepared from 3 parts by weight of the thus obtained toners and 100 parts by weight of substantially spherical iron oxide powder carrier having a volume resistivity of $10^9$ Ω·cm, an apparent density of 4.46 g/cm$^3$, and particle sizes of 74 to 149 μm, ASRV-10 (trademark of a product made by Nippon Teppun K.K., Japan). Triboelectric charge of the toners to the carriers was determined according to a blow-off method and found to be +20 μC/g.

A selenium drum rotating at a peripheral speed of about 30 cm/sec. was uniformly charged at +700 V by a corona charger, and information was written thereon by He—Ne laser and subjected to reversal development, using the said developing agent according to a magnetic brush method. Then, the toner images were transferred onto a continued paper sheet and fixed by a fixing apparatus of heat press roll type with a preheater at a roll temperature of 180° C., an interoll pressure of 4 kg f/cm$^2$, a nip width of 8.0 mm, and a fixing speed of 30 cm/sec. It was found that good images were obtained at a high image density without any fogging and any offsetting, showing a good fixability and a good PVC resistance. Then, a continuous printing test of 1,000,000 sheets was conducted while supplying the toners, and it was found that good images could be continuously obtained from the start to the end, and no filming of toners occurred at all on the selenium drum after the continuous printing.

EXAMPLE 14

Toners having particle sizes of 5 to 25 μm were prepared from 85 parts by weight of a binder resin, which consisted of 55 parts by weight of lactone-modified epoxy resin having a softening point of 124° C., a glass transition point of 72° C., and an ε-caprolactone content of 5% by weight, Placcel G7005 (trademark of a product made by Daicel Kagaku Kogyo K.K., Japan), 10 parts by weight of styrene-butadiene rubber used in Example 12, 35 parts by weight of non-linear, bisphenol-type polyester resin having a softening point of 141° C. and a glass transition point of 68.5° C., KTR 2120 (trademark of a product made by Kao Soap K.K., Japan), and 2 parts by weight of polypropylene having a molecular weight cf 8,600, Viscol 660P (trademark of a product made by Sanyo Kasei Kogyo K.K., Japan), 5 parts by weight of oleic acid-modified nigrosine dye Bontron N03 (trademark of a product made by Orient Kagaku Kogyo K.K., Japan), and 10 parts by weight of Carbon Black #44 trademark of a product made by Mitsubishi Kasei Kogyo K.K., Japan).

A developing agent was prepared from 4 parts by weight of the thus obtained toners and 100 parts by weight of substantially spherical ferrite carriers having a volume resistivity of $10^8$ Ω·cm, an apparent density of 1.91 g/cm$^3$, and particle sizes of 74 to 149 μm, KBN-120 (trademark of a product made by Hitachi Kinzoku K.K., Japan). Triboelectric charge of the toners to the carriers was determined according to a blow-off method and found to be +23 μC/g.

A selenium drum rotating at a peripheral speed of about 60 cm/sec. was uniformly charged at +720 V by a corona charger and information was written thereon by He—Ne laser and subjected to reversal development, using the said developing agent according to a magnetic brush method under a bias voltage of +400 V. Then, toner images were transferred onto a continued paper sheet and fixed by a fixing apparatus of heat press roll type with a preheater at a roll temperature of 180° C., an interoll pressure of 4 kg f/cm$^2$, a nip width of 8.0 mm and a fixing speed of 60 cm/sec. It was found that good images were obtained at a high image density without any fogging and any offsetting, showing a good fixability and a good PVC resistance. Then, a continuous printing test of 1,000,000 sheets while supplying the toners was conducted, and it was found that good images could be continuously obtained from the start to the end and no filming of toners occurred at all on the selenium drum after the continuous printing.

EXAMPLES 15 TO 26

Toners and developing agents were prepared from the same lactone-modified epoxy resin, styrene-butadiene rubber, and polyester resin as used in Example 12 under the same conditions for the toner composition, development, fixation, etc. as in Example 12. The resin compositions, and the results of evaluation are given in Table 2.

TABLE 2

| | Binder resin composition (wt. %) | | | Evaluation | | |
|---|---|---|---|---|---|---|
| Ex. No. | Lactone-modified epoxy resin | Styrene-butadiene rubber | Polyester resin | Fixability | Offset resistance | Others |
| 15 | 77 | 3 | 20 | O | Δ | |
| 16 | 75 | 5 | 20 | O | O | |
| 17 | 70 | 10 | 20 | O | O | |
| 18 | 60 | 20 | 20 | O | O | |
| 19 | 50 | 30 | 20 | O | O | |
| 20 | 48 | 32 | 20 | Δ | O | Poor preservation stability and PVC resistance |
| 21 | 87 | 10 | 3 | Δ | O | |
| 22 | 85 | 10 | 5 | O | O | |
| 23 | 80 | 10 | 10 | O | O | |
| 24 | 60 | 10 | 30 | O | O | |
| 25 | 40 | 10 | 50 | O | O | |
| 26 | 38 | 10 | 52 | O | Δ | Poor flowability |

Remark: O: good, Δ: fair

COMPARATIVE EXAMPLE 2

Toners were prepared in the same manner as in Example 12, using a binder resin consisting of 60 parts by weight of the lactone-modified epoxy resin, 40 parts by weight of the bisphenol-type polyester resin, and 2 parts by weight of the low molecular weight polypropylene without the styrene-butadiene rubber.

A developing agent was prepared using the thus obtained toners, and evaluated in the same manner as in Example 12. It was found that a good fixability and a good PVC resistance were obtained, but the toners were deposited on the felt for oil supply, provided at the heat press roll, resulting in insufficient oil supply and occurrence of offsetting.

COMPARATIVE EXAMPLE 3

Toners were prepared in the same manner as in Example 12, using a binder resin consisting of 85 parts by weight of the lactone-modified epoxy resin, 15 parts by weight of the styrene-butadiene rubber, and 2 parts by weight of the low molecular weight polypropylene without the bisphenol-type polyester resin.

A developing agent was prepared, using. the thus obtained toners, and evaluated in the same manner as in Example 12. It was found that a good offset resistance, a good PVC resistance, and a good filming resistance were obtained, but the fixability of the toners was poor and the toners were peeled off in an adhesive tape peeling test. Toners were found to be unpractical.

COMPARATIVE EXAMPLE 4

Toners were prepared in the same manner as in Example 12, using a lactone-unmodified epoxy resin Epikote 1007 (trademark of a product made by Shell Chemical Co.), and a developing agent was prepared, using the thus obtained toners, and evaluated in the same manner as in Example 12. It was found that a good fixability, a good offset resistance, and a good PVC resistance were obtained, but the filming resistance was poor and toner filming occurred on the selenium drum after the continuous printing. The toners were found to be unpractical.

What is claimed is:

1. A non-magnetic electrophotographic toner which comprises a binder resin, and a coloring agent, the binder resin containing a thermoplastic lactone-modified epoxy resin having a lactone content of 3 to 90% by weight, obtained by subjecting all or a portion of secondary hydroxyl groups of epoxy compounds having hydroxyl groups in the molecules to ring opening polymerization of ϵ-caprolactone.

2. A non-magnetic electrophotographic toner according to claim 1, wherein the lactone content is 3 to 80% by weight.

3. A non-magnetic electrophotographic toner which comprises a binder resin and a coloring agent, the binder resin containing:

(1) a ϵ-caprolactone-modified epoxy resin having a lactone content of 3 to 90% by weight, obtained by subjecting all or a portion of secondary hydroxyl groups of epoxy compounds having hydroxyl groups in the molecules to ring opening polymerization of ϵ-caprolactone, (2) styrene-butadiene rubber, and (3) polyester resin.

4. A non-magnetic electrophotographic toner according to claim 3, wherein the binder resin contains 5 to 30% by weight of the styrene-butadiene rubber and 5 to 50% by weight of the polyester resin on the basis of the total binder resin.

5. A non-magnetic electrophotographic toner according to claim 4, wherein the styrene-butadiene rubber of the binder resin is a partially cross-linked styrene-butadiene rubber having a gel content of 10 to 50% by weight.

6. A non-magnetic electrophotographic toner which comprises a binder resin and a coloring agent, the binder resin containing:

(1) a ϵ-caprolactone modified epoxy resin having a lactone content of 3 to 90% by weight, obtained by subjecting all or a portion of secondary hydroxyl groups of epoxy compounds having hydroxyl groups in the molecules to ring opening polymerization of ϵ-caprolactone, (2) 5 to 30% by weight of styrene-butadiene rubber on the basis of total binder resin, and (3) 5 to 50% by weight of polyester resin on the basis of total binder resin, and the toner having a melt viscosity of 100 to 10,000 poises at 160° C.

* * * * *